US011289025B2

(12) United States Patent
Wang et al.

(10) Patent No.: US 11,289,025 B2
(45) Date of Patent: Mar. 29, 2022

(54) PIXEL COMPENSATION CIRCUIT, DISPLAY APPARATUS, AND PIXEL COMPENSATION CIRCUIT DRIVING METHOD

(71) Applicant: BOE TECHNOLOGY GROUP CO., LTD., Beijing (CN)

(72) Inventors: Tangxiang Wang, Beijing (CN); Yi Chen, Beijing (CN); Zhan Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,104

(22) PCT Filed: May 26, 2020

(86) PCT No.: PCT/CN2020/092371
§ 371 (c)(1),
(2) Date: Dec. 22, 2020

(87) PCT Pub. No.: WO2020/248813
PCT Pub. Date: Dec. 17, 2020

(65) Prior Publication Data

US 2021/0264858 A1 Aug. 26, 2021

(30) Foreign Application Priority Data

Jun. 14, 2019 (CN) ..... 201910517083.4

(51) Int. Cl.
*G09G 3/3258* (2016.01)
*G09G 3/3241* (2016.01)

(52) U.S. Cl.
CPC ..... *G09G 3/3258* (2013.01); *G09G 3/3241* (2013.01); *G09G 2310/08* (2013.01)

(58) Field of Classification Search
None
See application file for complete search history.

(56) References Cited

U.S. PATENT DOCUMENTS 9,734,760 B2 8/2017 Wu et al.
10,269,301 B2 4/2019 Kishi et al.
(Continued)

FOREIGN PATENT DOCUMENTS

CN 103247261 A 8/2013
CN 105282951 A 1/2016
(Continued)

OTHER PUBLICATIONS

International Search Report and Written Opinion for International Application No. PCT/CN2020/092371 dated Aug. 27, 2020.
(Continued)

*Primary Examiner* — Kirk W Hermann
(74) *Attorney, Agent, or Firm* — Thomas | Horstemeyer, LLP

(57) ABSTRACT

A pixel compensation circuit includes: an integration circuit, a comparison circuit, a timing circuit, and a processor, wherein the integration circuit is configured to integrate driving currents of a pixel circuit, and then output a first voltage; the comparison circuit is configured to receive the first voltage, compare the first voltage with a first reference voltage, and then output a first logic control signal; the timing circuit is configured to acquire a first working duration; and the processor is configured to acquire the first working duration, obtain, according to correlations between the pre-obtained working duration and the pixel driving currents, a target driving current, corresponding to the first working duration, of the pixel circuit, and obtain a compensation parameter according to the target driving current.

16 Claims, 7 Drawing Sheets

(56) References Cited

U.S. PATENT DOCUMENTS

| | | | | |
|---|---|---|---|---|
| 10,439,630 | B2 | 10/2019 | Song et al. | |
| 2015/0008841 | A1 | 1/2015 | Wu et al. | |
| 2018/0061328 | A1* | 3/2018 | Kishi | G09G 3/3225 |
| 2019/0123761 | A1 | 4/2019 | Song et al. | |
| 2019/0147329 | A1* | 5/2019 | Hekmatshoartabari | G06N 3/0635 706/26 |
| 2020/0111398 | A1* | 4/2020 | Lee | G09G 3/20 |
| 2020/0175923 | A1* | 6/2020 | Kim | G09G 3/3258 |

FOREIGN PATENT DOCUMENTS

| | | | |
|---|---|---|---|
| CN | 105702209 | A | 6/2016 |
| CN | 106328061 | A | 1/2017 |
| CN | 105282951 | B | 9/2017 |
| CN | 108206007 | A | 6/2018 |
| CN | 108615491 | A | 10/2018 |
| CN | 108880542 | A | 11/2018 |
| CN | 109377945 | A | 2/2019 |
| CN | 110164374 | A | 8/2019 |
| EP | 2991066 | A1 | 3/2016 |
| EP | 3622626 | A1 | 3/2020 |
| JP | H06313840 | A | 11/1994 |
| JP | H11282420 | A | 10/1999 |
| WO | 2018205479 | A1 | 11/2018 |
| WO | 2019218963 | A1 | 11/2019 |

OTHER PUBLICATIONS

First Office Action for CN Patent Application No. 201910517083.4 dated Jul. 21, 2020.
Second Office Action for CN Patent Application No. 201910517083.4 dated Feb. 20, 2021.

* cited by examiner

PIXEL COMPENSATION CIRCUIT, DISPLAY APPARATUS, AND PIXEL COMPENSATION CIRCUIT DRIVING METHOD

CROSS-REFERENCE TO RELATED APPLICATIONS

This application is a national phase application under 35 U.S.C. § 371 of International Patent Application No. PCT/CN2020/092371, filed on May 26, 2020, which claims the benefit of and priority to Chinese Patent Application No. 201910517083.4 filed on Jun. 14, 2019, where the entire contents of both of which are incorporated by reference herein as a part of the present application.

TECHNICAL FIELD

The present disclosure relates to the technical field of display devices and, in particular to a pixel compensation circuit, a display device, and a driving method of the pixel compensation circuit.

BACKGROUND

AMOLED (Active Matrix Light Emitting Diode or Active Matrix Organic Light Emitting Diode) is a display technology used in display devices. A MOLED has been used in high level electric potential and mobile device products due to its advantages of ultra-light and thin, high color gamut, high contrast, wide viewing angle, fast response, and the like.

AMOLED is an active type driving, in which a driving thin-film transistor (TFT) is included. Due to a deviation of a TFT process, some parameters of respective driving transistors, such as threshold voltage and electron mobility, may not be completely consistent, which may cause serious display non-uniformity. At the same time, an infrared pressure drop (IR Drop) on a panel and non-uniformity of an AMOLED driving voltage may affect the display uniformity. In summary, in an AMOLED-based pixel design, compensation technology needs to be used to compensate for non-ideal characteristics of the process.

SUMMARY

The present disclosure is providing a pixel compensation circuit, a display device, and a driving method of the pixel compensation circuit.

The present disclosure provides a pixel compensation circuit, including: an integration circuit, a comparison circuit, a timing circuit, and a processor (e.g., at least one hardware processor);

wherein a terminal of the integration circuit is coupled to a pixel circuit to be compensated, and the other terminal thereof is coupled to a first node, and the integration circuit is configured to integrate a driving current of the pixel circuit to output a first voltage;

a terminal of the comparison circuit is connected to the first node, and the other terminal thereof is coupled to the timing circuit, and the comparison circuit is configured to receive the first voltage and compare the first voltage with a first reference voltage, and output a first logic control signal in a case where the first voltage and the first reference voltage satisfy a first relationship;

the timing circuit is also respectively coupled to the processor and a start signal input terminal, and is configured to start timing when a start signal is received, and stop timing when the first logic control signal is received, to obtain a first working duration; and the processor is configured to obtain the first working duration, obtain a target driving current of the pixel circuit corresponding to the first working duration according to a pre-obtained correspondence between working durations and pixel driving currents, and obtain a compensation parameter according to the target driving current.

Optionally, the integration circuit includes an operational amplifier, a first capacitor, a first switch, a second switch, and a third switch;

wherein an inverting input terminal of the operational amplifier is coupled to a second node, a non-inverting input terminal thereof is coupled to a second reference voltage input terminal, and an output terminal thereof is coupled to the first node through the third switch; the second node is coupled to the pixel circuit through the first switch; and a first terminal of the first capacitor is coupled to the second node, and a second terminal thereof is coupled to the first node through the second switch.

Optionally, the comparison circuit includes a comparator, an inverting input terminal of the comparator is coupled to the first node, a non-inverting input terminal thereof is coupled to a first reference voltage input terminal, and an output terminal thereof is coupled to the timing circuit.

Optionally, the timing circuit includes a timer, a first terminal of the timer is connected to the comparison circuit, a second terminal thereof is coupled to the start signal input terminal, and a third terminal thereof is coupled to the processor.

Optionally, the integration circuit further includes a reference current source, a fourth switch and a fifth switch;

the reference current source is coupled to the second node through the fourth switch, and the second terminal of the first capacitor is also grounded through the fifth switch; and the processor is coupled to the second node through a sixth switch and a seventh switch.

Optionally, the first node and the second node are coupled through a seventh switch.

The present disclosure further provides a display device including the pixel compensation circuit.

The present disclosure further provides a driving method of a pixel compensation circuit, the driving method including:

obtaining a driving current of a pixel circuit to be compensated when the pixel circuit works abnormally; and obtaining a compensation parameter of the pixel circuit according to the driving current of the pixel circuit, wherein the obtaining the compensation parameter of the pixel circuit includes: starting timing based on a start signal; integrating the driving current of the pixel circuit to obtain a first voltage, comparing the first voltage with a first reference voltage, and outputting a first logic control signal in a case where the first voltage and the first reference voltage satisfy a first relationship; stop timing when the first logic control signal is obtained, to obtain a first working duration; and obtaining a target driving current of the pixel circuit corresponding to the first working duration according to a pre-obtained correspondence between working durations and pixel driving currents, and obtaining a compensation parameter according to the target driving current.

Further, the obtaining the compensation parameter of the pixel circuit includes:

closing a first switch, a second switch and a third switch, inputting the start signal to the timer, inputting a second reference voltage to a non-inverting input terminal of the operational amplifier, and inputting the first reference voltage to a non-inverting input terminal of the comparator.

Further, before the obtaining the compensation parameter of the pixel circuit, the method further includes: closing a fourth switch, a fifth switch, a sixth switch, and a seventh switch;

outputting a constant current, by the reference current source, to charge the first capacitor;

obtaining, by the processor, a voltage of the second node, calculating, by the processor, a parameter of the first capacitor according to the voltage of the second node, and calculating an error parameter of the first capacitor according to the parameter of the first capacitor and a standard capacitor parameter; and after obtaining the compensation parameter, adjusting the compensation parameter of the pixel circuit according to the error parameter.

In addition, the method further includes:

in a case where the pixel circuit works normally, closing a first switch and a seventh switch, outputting a third reference voltage to the non-inverting input terminal of the comparator;

comparing, by the comparator, a driving voltage of the pixel circuit with the third reference voltage, outputting a second logic control signal to the timer when the driving voltage and the third reference voltage satisfies a second relationship, and outputting a third logic control signal to the timer when the driving voltage and the third reference voltage satisfies a third relationship;

starting timing by the timer after receiving the second logic control signal, and stopping timing after receiving the third logic control signal, to obtain a second working duration; and accumulating, by the processor, multiple consecutively received second working durations to obtain an accumulated duration, and performing aging compensation on the pixel circuit when the pixel circuit enters the working state next time in a case where the accumulated duration reaches a preset duration; and clearing the accumulation duration.

BRIEF DESCRIPTION OF THE DRAWINGS

The drawings herein, which are incorporated in and constitute a part of this specification, illustrate embodiments consistent with the present disclosure, and serve to explain the principles of the present disclosure together with the description. Understandably, the drawings in the following description are just some embodiments of the present disclosure. For those of ordinary skill in the art, other drawings may be obtained based on these drawings without creative efforts.

DETAILED DESCRIPTION

Since an AMOLED compensation concept was first proposed in the 1990s, compensation technology for AMOLED has been constantly innovating. Conventional methods generally use an internal compensation. The so-called internal compensation refers to the use of TFTs to build sub-circuits inside the pixels. However, both a pixel structure and a driving method for the internal compensation are relatively complicated, and only have a compensation effect on non-uniformity of a TFT threshold voltage and IR, which cannot solve problems such as afterimages. At the same time, in large-size and high-resolution display applications, the internal compensation method may cause the problems of low aperture ratio and slow driving speed. An external compensation has the advantages of high driving speed and good compensation effect, and thus the external compensation is considered as a better compensation method.

Most of the external compensations used in the related art are voltage-type external compensations, that is, an OLED voltage of a pixel is extracted in some way and converted into a digital signal for processing, thereby realizing compensation. However, the voltage-based external compensation method is susceptible to interference. In addition, as a size increases, a resolution increases, a parasitic capacitance of a panel becomes larger and larger, a sense voltage value within a fixed time becomes lower, and accuracy requirements of other subsequent processors become higher and higher.

Embodiments of the present disclosure provide a pixel compensation circuit, a display device, and a driving method of the pixel compensation circuit, to at least partially solve the problems that the voltage-type external compensation method in the related art is easily interfered; also as the size increases, the resolution increases, the parasitic capacitance becomes larger and larger, the sense voltage value in a fixed time becomes lower, and the accuracy requirement of an analog-to-digital converter (ADC) becomes higher and higher.

In order to make the above objectives, features and advantages of the present disclosure more apparent and easy to understand, the present disclosure will be further described in detail below in conjunction with the accompanying drawings and specific embodiments.

Embodiment 1

Figure 1:
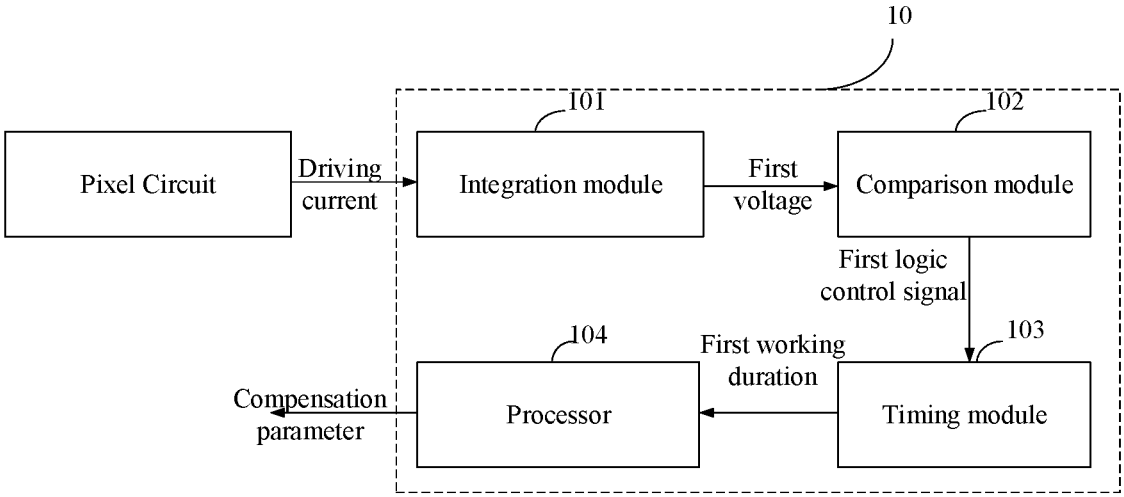
FIG. 1 shows a basic structure diagram of a pixel compensation circuit of Embodiment 1 of the present disclosure.

Referring to FIG. 1, a pixel compensation circuit of Embodiment 1 according to the present disclosure is shown.

The pixel compensation circuit 10 of the embodiment of the present disclosure includes: an integration circuit 101, a comparison circuit 102, a timing circuit 103, and a processor 104;

a terminal of the integration circuit is coupled to a pixel circuit to be compensated, and the other terminal thereof is coupled to a first node, and the integration circuit is configured to integrate a driving current of the pixel circuit to output a first voltage;

a terminal of the comparison circuit is connected to the first node, and the other terminal thereof is coupled to the timing circuit, and the comparison circuit is configured to receive the first voltage and compare the first voltage with a first reference voltage, and output a first logic control signal in a case where the first voltage and the first reference voltage satisfy a first relationship;

the timing circuit is also respectively coupled to the processor and a start signal input terminal, and is configured to start timing when a start signal is received, and stop timing when the first logic control signal is received, to obtain a first working duration; and the processor is configured to obtain the first working duration, obtain a target driving current of the pixel circuit corresponding to the first working duration according to a pre-obtained correspondence between working durations and pixel driving currents, and obtain a compensation parameter according to the target driving current.

Figure 2:
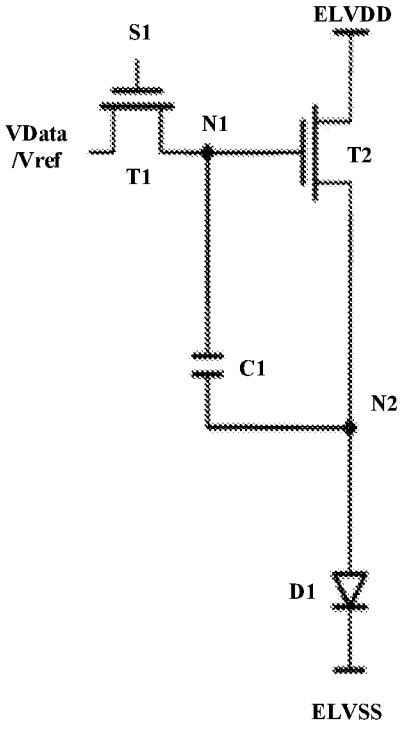
FIG. 2 shows a circuit diagram of a pixel circuit of Embodiment 1 of the present disclosure.

In an embodiment of the present disclosure, referring to FIG. 2, the pixel circuit to be compensated is a conventional 2T1C pixel circuit, including two thin film transistors and one capacitor. The transistor T1 is used to transmit image data Vdata or reference voltage Vref under the control of a row scan switch S1, and is called a switching transistor; the transistor T2 is used to control a working state of an OLED D1, and is called a driving transistor; and the capacitor C1 is used to maintain a gate electrode voltage on the driving transistor. Wherein, a gate electrode of the switching transistor T1 is connected to the scan switch S1, a source electrode thereof is connected to a data line Data, and a drain electrode thereof is connected to a gate electrode of the driving transistor; a source electrode of the driving transistor is connected to a power supply voltage ELVDD, and a drain electrode thereof is connected to an anode of the OLED; a cathode of the OLED is connected to a low level ELVSS; and the capacitor C1 is connected in parallel between the gate electrode and the drain electrode of the driving transistor. The driving current of the pixel circuit, that is, a working current of the OLED D1 may be expressed as $IOLED=K(V_{GS}+V_{th})^2$, where VGS is a voltage between the gate electrode and the drain electrode of the driving transistor, Vth is a threshold voltage of the driving transistor, and K is a coefficient.

Referring to FIG. 2, the anode terminal of D1 in the pixel circuit has a connection point N2, and the N2 is an access point of the compensation circuit, where the driving circuit uses the access point to connect to the pixel circuit. The external compensation circuit described in the embodiment adopts a current-type external compensation method to obtain the driving current of the OLED, so that a problem that a voltage signal is easily interfered during a wiring process is avoided. When the external circuit compensates for a drift of TFT characteristics, and by sensing the driving current of the pixel and using the difference in time for different currents to charge and discharge the capacitor to a certain voltage, the driving circuit obtains a digital signal representing the time. The digital signal is sent to the processor, and then Vdata is fine-tuned to achieve the TFT compensation.

In one embodiment, the integrating circuit is coupled to the pixel circuit, and after integrating the driving current of the pixel circuit, the first voltage is output. The first voltage gradually decreases over time. When the first voltage drops below the first reference voltage in the comparison circuit, the comparison circuit outputs the first logic control signal, to control the timing circuit to stop timing. The timing circuit starts timing when it receives the start signal, and the timing circuit obtains the first working duration, which is a digital signal or a clock signal. After receiving the first working duration, the processor obtains the target driving current of the pixel circuit corresponding to the first working duration according to the pre-obtained correspondence between the working duration and the pixel driving current. In an embodiment, the correspondence between the working duration and the pixel driving current may be: when the power supply voltage of the driving circuit is 12V, the working duration is 13.14 μs, and the corresponding pixel driving current is 100 nA; the working duration is 3.39 μs, and the corresponding pixel driving current is 1 μA; and the working duration is 1.9 μs, and the corresponding pixel driving current is 3 μA. When the power supply voltage of the driving circuit is 16V, the working duration is 12.19 μs, and the corresponding pixel driving current is 100 nA; the working duration is 3.39 μs, and the corresponding pixel driving current is 1 μA; and the working duration is 1.92 μs, and the corresponding pixel driving current is 3 μA. When the power supply voltage of the driving circuit is 18V, the working duration is 12.78 μs, and the corresponding pixel driving current is 100 nA; the working duration is 3.38 μs, and the corresponding pixel driving current is 1 μA; and the working duration is 1.92 μs, and the corresponding pixel driving current is 3 μA. From the above, it can be seen that the working duration is negatively correlated with the driving current. That is, the shorter the first working duration corresponding to that the integration circuit is charged and discharged, through the driving current of the pixel circuit, to a certain voltage, the larger the corresponding target driving current of the pixel circuit. The processor obtains the compensation parameter of the pixel circuit according to the target driving current. In one embodiment, the compensation parameter is a TFT compensation parameter.

Figure 3:
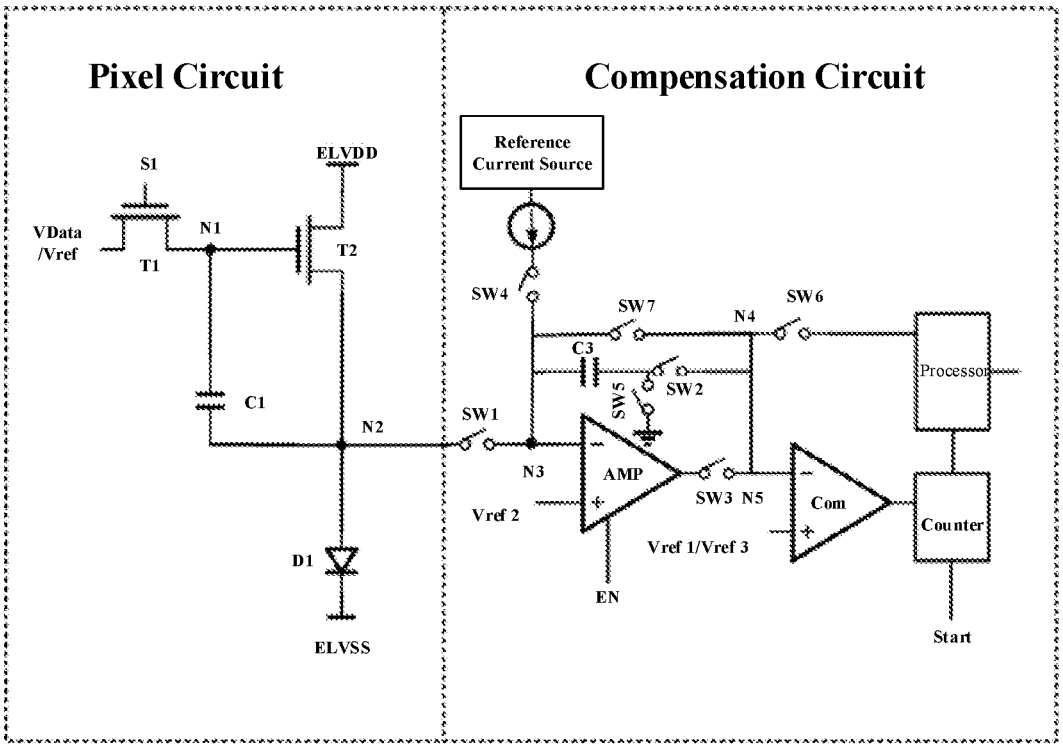
FIG. 3 shows a circuit diagram of the pixel compensation circuit of Embodiment 1 of the present disclosure.

In one embodiment, referring to FIG. 3, the integration circuit includes an operational amplifier, a first capacitor, a first switch, a second switch, and a third switch;

wherein an inverting input terminal of the operational amplifier is coupled to a second node N3, a non-inverting input terminal thereof is coupled to a second reference voltage input terminal (Vref2), and a output terminal thereof is coupled to the first node through the third switch; the second node is coupled to the pixel circuit through the first switch; and a first terminal of the first capacitor is coupled to the second node, and a second terminal thereof is coupled to the first node through the second switch.

The comparison circuit includes a comparator, an inverting input terminal of the comparator is coupled to the first node, a non-inverting input terminal thereof is coupled to a first reference voltage input terminal, and an output terminal thereof is connected to the timing circuit.

The timing circuit includes a timer (or counter), a first terminal of the timer is connected to the comparison circuit, a second terminal thereof is coupled to the start signal input terminal, and a third terminal thereof is coupled to the processor.

A first terminal of the processor is coupled to the first node through a sixth switch and is coupled to the second node through the sixth switch and a seventh switch, a second terminal thereof is coupled to the timer, and a third terminal is an output terminal.

In the embodiment of the present disclosure, before the compensation circuit performs TFT compensation on the pixel circuit, the first switch SW1, the second switch SW2, the third switch SW3 and the seventh switch SW7 are closed, a high level is input to an EN terminal of the operational amplifier, the operational amplifier works, and an inverting terminal of the operational amplifier is connected to the second reference voltage source. The second reference voltage of the second reference voltage source is Vref2 (lower than Voled+ELVSS to ensure that the OLED does not emit light). Due to negative feedback, an output voltage of the operational amplifier is Vref2.

Figure 4:
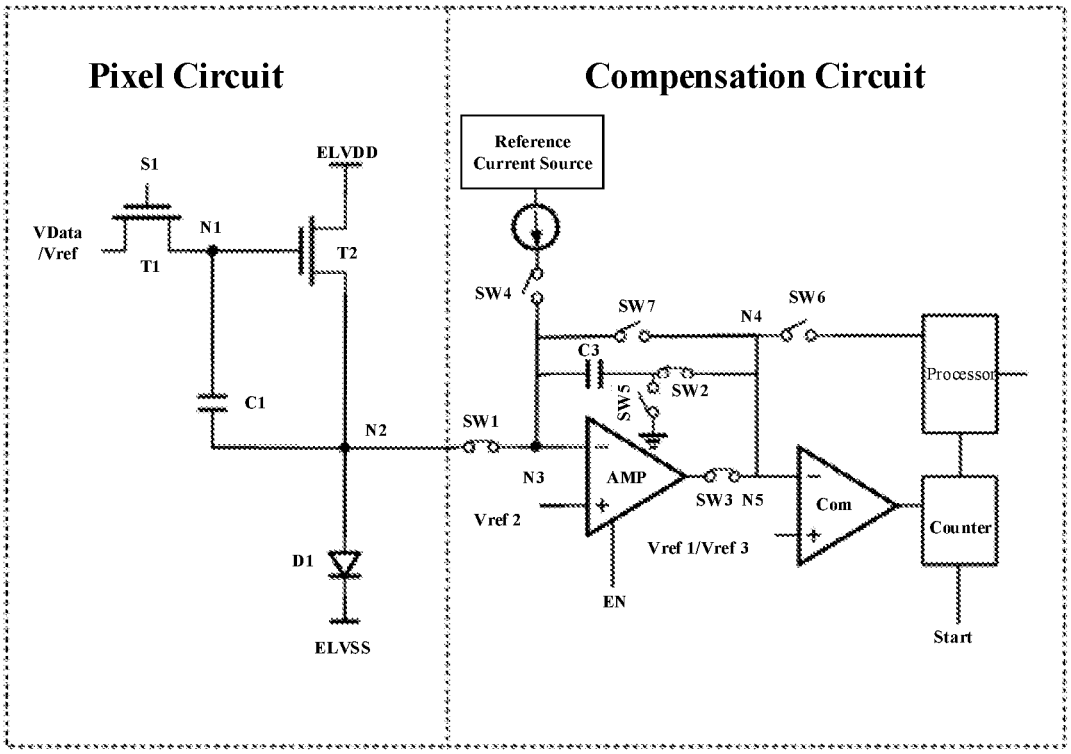
FIG. 4 shows a circuit diagram of the pixel compensation circuit when performing TFT compensation of Embodiment 1 of the present disclosure.

Referring to FIG. 4, it shows a principle diagram when the compensation circuit performs TFT compensation on the pixel circuit. At this time, T1 is closed through S1, and a Vref value is transferred to close T2. At the same time, SW7 is opened, a pulse signal is given by Start, and the timer starts timing. Due to the existence of a first capacitor C3, the current charges the capacitor C3, so that an output voltage of a first node N5 starts to decrease from Vref2. The larger the current, the faster the voltage of the node N5 decreases. When the voltage decreases to Vref1 (lower than Vref2), the comparator flips, the timer stops working, and a time period required for the voltage of N5 to change from Vref2 to Vref1 is recorded and sent to the processor for processing, so as to calculate the pixel drive current. Further, a characteristic drift (k value and $V_{th}$) of the TFT is calculated according to Formula $I_{OLED}=K(V_{GS}+V_{th})^2$, and by fine-tuning Vdata, the current reaches an expected value when the next frame emits light, thereby achieving TFT compensation.

Optionally, the integration circuit further includes a reference current source, a fourth switch and a fifth switch;

the reference current source is coupled to the second node through the fourth switch, and the second terminal of the first capacitor is also grounded through the fifth switch; and the processor is coupled to the second node through a sixth switch and a seventh switch.

The processor is further configured to obtain a parameter of the first capacitor, calculate an error parameter of the first capacitor using the parameter of the first capacitor and a standard capacitor parameter, and adjust the compensation parameter according to the error parameter after obtaining the compensation parameter.

In the embodiment of the present disclosure, it takes a certain amount of time to compensate each point in the pixel circuit. For example, with a resolution of 4K, there are 2160 points on each row. In a limited blanking time, compensation for these points one by one is often not allowed in time. Therefore, parallel processing is required, such as requiring multiple integrating capacitors, or multiple chips working at the same time, which involves accuracy issues, especially capacitor accuracy issues. Due to the process characteristics, passive components (resistors and/or capacitors) in an integrated circuit manufacturing process fluctuate greatly, and the capacitor accuracy directly affects the length of the current charging time in the integrator, so it is necessary to perform a calibration operation prior to startup.

Figure 5:
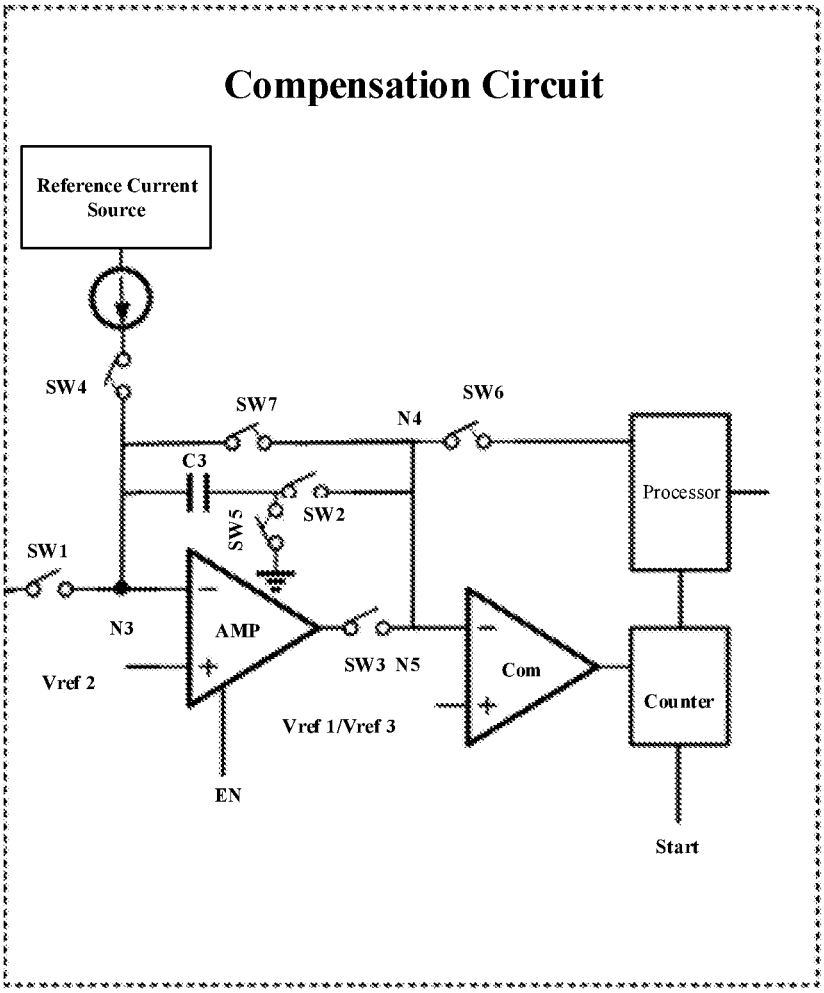
FIG. 5 shows a specific circuit diagram of a compensation circuit when performing capacitance correction on the pixel circuit of Embodiment 1 of the present disclosure.

During the calibration (refer to FIG. 5), the fourth switch, fifth switch, sixth switch and seventh switch are closed, the other switches are opened, and the operational amplifier, comparator and timer do not work. The reference current source charges the adopted first capacitor C3 with the same current. After the voltage of the second node N3 is stable, the voltage of the second node N3 is recorded and sent to the processor. The processor records and calculates an error coefficient of each capacitor and a standard capacitor, which is considered when calculating the K value and Vth.

In an embodiment, the first node and the second node are coupled through a seventh switch.

The comparison circuit is further configured to compare a driving voltage applied to a light-emitting element in the pixel circuit with a third reference voltage when the pixel circuit enters a working state, output a second logic control signal when a comparison result satisfies a second relationship, and output a third logic control signal when the comparison result satisfies a third relationship;

the timing circuit is further configured to start timing after receiving the second logic control signal, and stop timing after receiving the third logic control signal, to obtain a second working duration; and the processor is further configured to perform aging compensation on the pixel circuit when the pixel circuit enters the working state next time in a case where an accumulated duration of a plurality of consecutive second working durations reaches a preset duration; and clear the accumulation duration.

In the embodiment of the present disclosure, for OLED aging, some current methods are to measure an anode voltage of the OLED and estimate a luminous efficiency of the OLED accordingly, and record the luminous efficiency of the OLED at different voltages in a look-up table in advance. For example, if the efficiency is reduced by 10% compared to an initial value, the current needs to be increased by 10% to achieve the aging compensation for the OLED. This may improve the afterimage problem to a certain extent and improve the uniformity problem, but there are some problems. For example, there is no clear and firm relationship between the anode voltage of the OLED and the luminous efficiency, and it can only roughly fit the trend. Secondly, it is inconvenient to obtain the look-up table, and it is necessary to sense the anode voltage of the OLED multiple times and record the corresponding luminous efficiency through a photometer. Only the denser the recorded voltage, the closer the fitted curve is to the true value. Moreover, the voltage and efficiency curves of different batches of OLEDs are also inconsistent, and there is no reusability.

Figure 6:
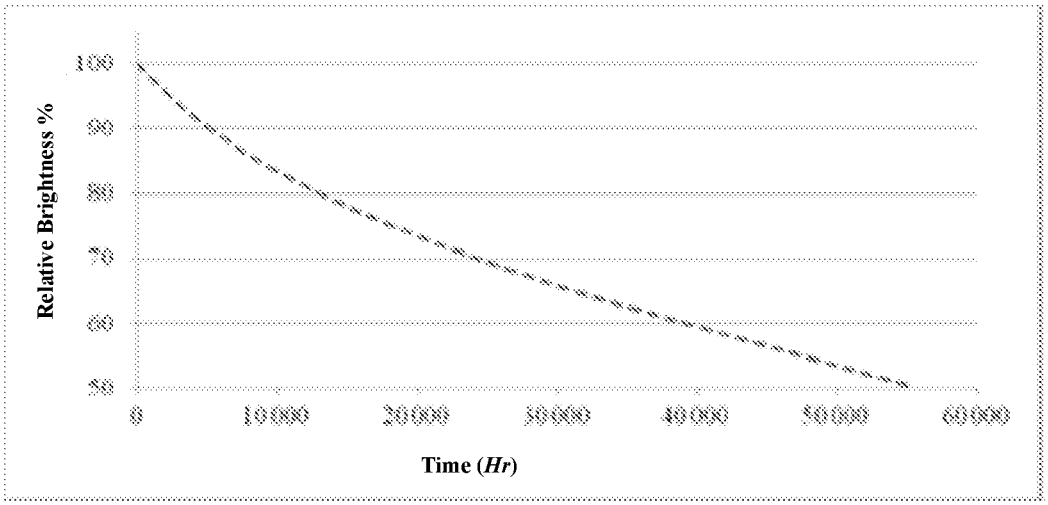
FIG. 6 shows a schematic diagram of a decay of OLED brightness over time of the pixel circuit in Embodiment 1 of the present disclosure.

Compared to the anode voltage of the OLED, the light-emitting time of the OLED is more closely related to the luminous efficiency thereof (refer to FIG. 6). A large number of studies have shown that under the same current, the OLED brightness decays with time, and it reflects an exponential law, $$L(t) = L(0)\exp\left[-\left(\frac{t}{a}\right)^{\frac{1}{n}}\right],$$

where t is the light-emitting time, L(t) is the brightness value at time t, L(0) is the initial brightness value of L(t), a is a constant, and n is a reference factor. When a and n are fixed values, the light-emitting time determines the brightness of the OLED. Therefore, accurately sensing the light-emitting time of the OLED is a more practical way to evaluate the brightness of the OLED.

Figure 7:
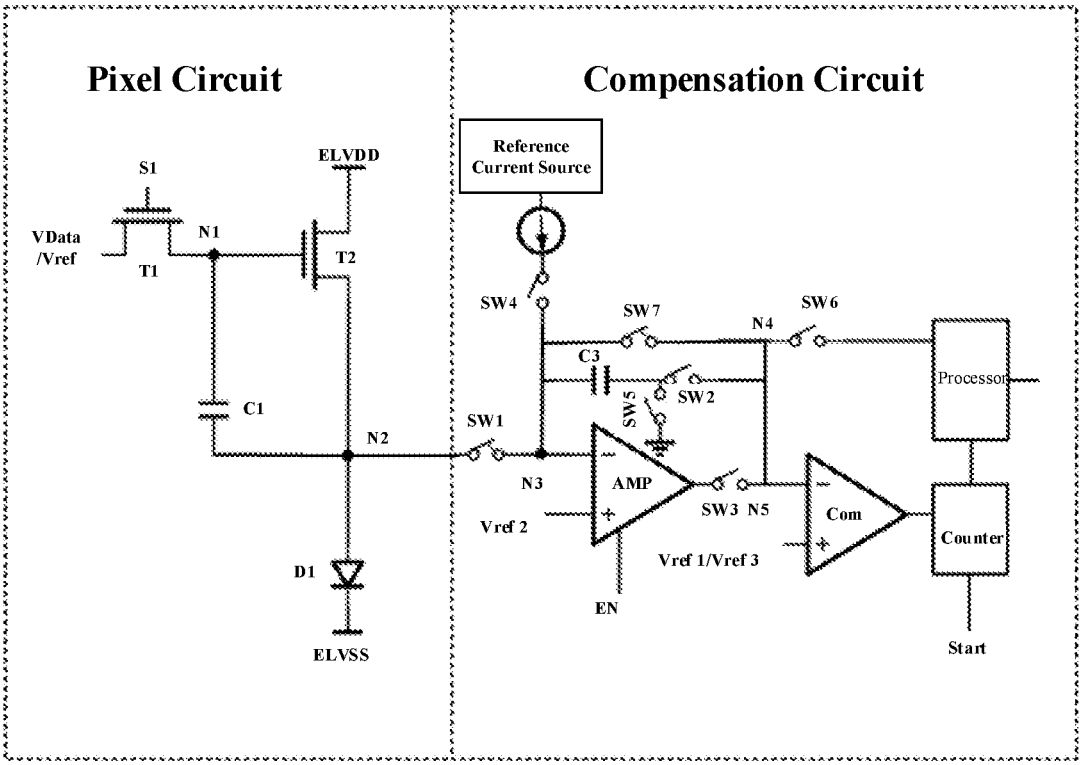
FIG. 7 shows a specific circuit diagram of a compensation circuit when performing aging compensation on the pixel circuit in Embodiment 1 of the present disclosure.

In the embodiment, the anode voltage of the OLED is detected to determine whether the OLED emits light, thereby triggering the light-emitting timing. In an example, referring to FIG. 7, the operational amplifier is opened by EN (EN is the abbreviation of "enable" in English to indicate enable, which means that each circuit or circuit can work), the first switch SW1 and the seventh switch SW7 are closed, the other switches are opened, and the positive terminal of the comparator is connected to the reference voltage Vref3 (which is slightly lower than the voltage required for OLED to emit light). Once the voltage of the node N5 is higher than Vref3, it is determined to enter the light-emitting state, and the timer starts timing until the anode voltage of the OLED is lower than Vref3, stop timing, to obtain the second working duration, which is then sent to the processor. The processor stores the plurality of previous second working durations, and accumulates the plurality of second working durations to obtain the accumulated duration. In a case where the accumulated duration reaches the preset duration, when the pixel circuit enters the working state next time, the aging compensation is performed on the pixel circuit; and the accumulated duration is cleared. Because the OLED aging is a relatively long process, generally, there is no need for real-time compensation. The compensation may be performed at each defined fixed time, for example, the compensation may be performed every 10 days. Also, when the accumulated duration reaches an integer multiple of 10 days, the aging compensation for the OLED is performed once at the next startup.

Embodiment 2

Figure 12:
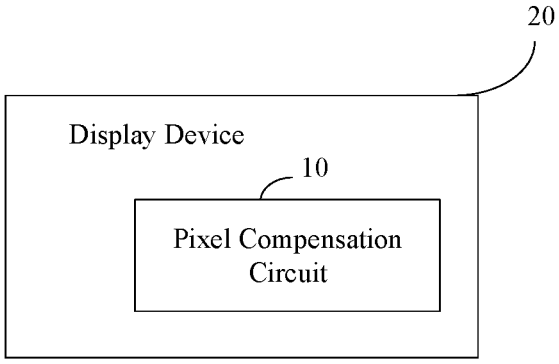
FIG. 12 shows a block diagram of a display device according to Embodiment 2 of the present disclosure.

Referring to FIG. 12, Embodiment 2 of the present disclosure discloses a display device 20, which is characterized by including the pixel compensation circuit 10. The pixel compensation circuit includes an integration circuit, a comparison circuit, a timing circuit, and a processor;

a terminal of the integration circuit is coupled to a pixel circuit to be compensated, and the other terminal thereof is coupled to a first node, and the integration circuit is configured to integrate a driving current of the pixel circuit to output a first voltage;

a terminal of the comparison circuit is connected to the first node, and the other terminal thereof is coupled to the timing circuit, and the comparison circuit is configured to receive the first voltage and compare the first voltage with a first reference voltage, and output a first logic control signal in a case where the first voltage and the first reference voltage satisfy a first relationship;

the timing circuit is also respectively coupled to the processor and a start signal input terminal, and is configured to start timing when a start signal is received, and stop timing when the first logic control signal is received, to obtain a first working duration;

the processor is configured to obtain the first working duration, obtain a target driving current of the pixel circuit corresponding to the first working duration according to a pre-obtained correspondence between working durations and pixel driving currents, and obtain a compensation parameter according to the target driving current, such that parameter compensation is performed on the pixel circuit according to the compensation parameter.

The pixel compensation circuit in the display device in the embodiment of the present disclosure adopts the current-type external compensation method, so that the problem that the voltage signal is easily interfered during the wiring process is avoided.

Embodiment 3

Figure 8:
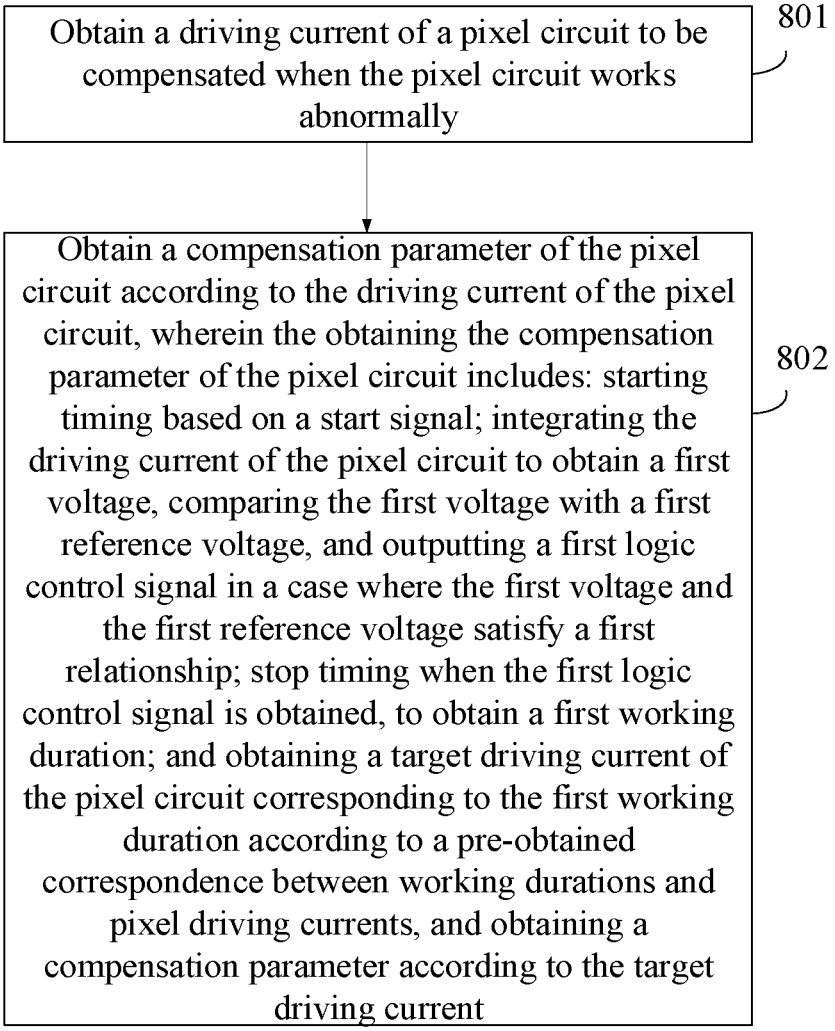
FIG. 8 shows a flowchart of main steps of a driving method of a pixel compensation circuit according to Embodiment 3 of the present disclosure.

Referring to FIG. 8, Embodiment 3 of the present disclosure discloses a driving method of a pixel compensation circuit, the driving method including:

in Step 801, obtaining a driving current of a pixel circuit to be compensated when the pixel circuit works abnormally; and in Step 802, obtaining a compensation parameter of the pixel circuit according to the driving current of the pixel circuit, wherein the obtaining the compensation parameter of the pixel circuit includes: starting timing when a start signal is received; integrating the driving current of the pixel circuit to obtain a first voltage, comparing the first voltage with a first reference voltage, and outputting a first logic control signal in a case where the first voltage and the first reference voltage satisfy a first relationship; stop timing when the first logic control signal is received, to obtain a first working duration; and obtaining a target driving current of the pixel circuit corresponding to the first working duration according to a pre-obtained correspondence between working durations and pixel driving currents, and obtaining a compensation parameter according to the target driving current.

In the embodiment of the present disclosure, an anode voltage of an OLED in the pixel circuit is measured, and when the anode voltage is less than a preset voltage, TFT compensation is performed on the pixel circuit. In an embodiment, the timing is started according to the start signal, for example, the start signal is output when the anode voltage is less than the preset voltage. The driving current of the pixel circuit is integrated to obtain the first voltage and the first voltage is compared with the first reference voltage. The first logic control signal is output in a case where the first voltage and the first reference voltage satisfy a first relationship. The timing is stopped when the first logic control signal is obtained, to obtain the first working duration. The target driving current of the pixel circuit corresponding to the first working duration is obtained according to the pre-obtained correspondence between the working duration and the pixel driving current. The compensation parameter is obtained according to the target driving current.

Figure 9:
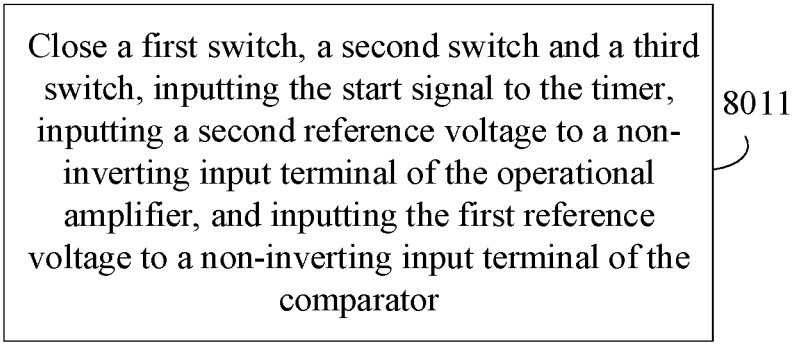
FIG. 9 shows a flowchart of sub-steps of a driving method of a pixel compensation circuit according to Embodiment 3 of the present disclosure.

In an embodiment, referring to FIG. 9, the obtaining the compensation parameter of the pixel circuit includes:

in Step 8011, closing a first switch, a second switch and a third switch, inputting the start signal to the timer, inputting a second reference voltage to a non-inverting input terminal of the operational amplifier, and inputting the first reference voltage to a non-inverting input terminal of the comparator.

In the embodiment of the present disclosure, a high level is input to an EN terminal of the operational amplifier, the operational amplifier works, and a negative terminal of the operational amplifier is connected to the second reference voltage source. The second reference voltage of the second reference voltage source is Vref2 (lower than Voled+ELVSS to ensure that the OLED does not emit light). Due to negative feedback, an output voltage of the operational amplifier is Vref2. At this time, T1 is closed through S1, and a Vref value is transferred to close T2. At the same time, a pulse signal is given by Start, and the timer starts timing. Due to the existence of a first capacitor C3, the current charges the capacitor C3, so that an output voltage of a first node N5 starts to decrease from Vref2. The larger the current, the faster the voltage of the node N5 decreases. When the voltage decreases to Vref1 (lower than Vref2), the comparator flips, the timer stops working, and a time period required for the voltage of N5 to change from Vref2 to Vref1 is recorded and sent to the processor for processing, so as to calculate the pixel drive current. Further, a characteristic drift (k value and $V_{th}$) of the TFT is calculated according to Formula $I_{OLED}=K(V_{GS}+V_{th})^2$, and by fine-tuning Vdata, the current reaches an expected value when the next frame emits light, thereby achieving TFT compensation.

Figure 10:
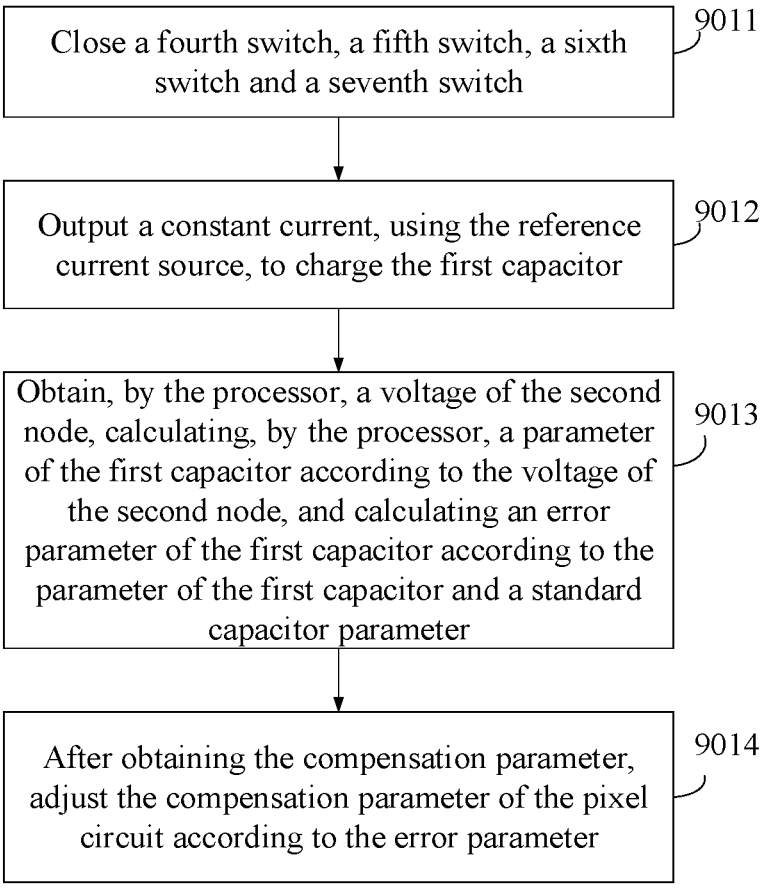
FIG. 10 shows a flowchart of other steps of a driving method of a pixel compensation circuit according to Embodiment 3 of the present disclosure.

In an embodiment, referring to FIG. 10, before the obtaining the compensation parameter of the pixel circuit, further including: in Step 9011, closing a fourth switch, a fifth switch, a sixth switch and a seventh switch;

in Step 9012, outputting a constant current, by the reference current source, to charge the first capacitor;

in Step 9013, obtaining, by the processor, a voltage of the second node, calculating, by the processor, a parameter of the first capacitor according to the voltage of the second node, and calculating an error parameter of the first capacitor according to the parameter of the first capacitor and a standard capacitor parameter; and in Step 9014, after obtaining the compensation parameter, adjusting the compensation parameter of the pixel circuit according to the error parameter.

In the embodiment of the present disclosure, during calibration, the fourth switch, fifth switch, sixth switch and seventh switch are closed, the other switches are opened, and the operational amplifier, comparator and timer do not work. The reference current source charges the adopted first capacitor with the same current. After the voltage of the second node N3 is stable, the voltage of the second node N3 is recorded and sent to the processor. The processor records and calculates an error coefficient of each capacitor and a standard capacitor, which is considered when calculating the K value and Vth.

Figure 11:
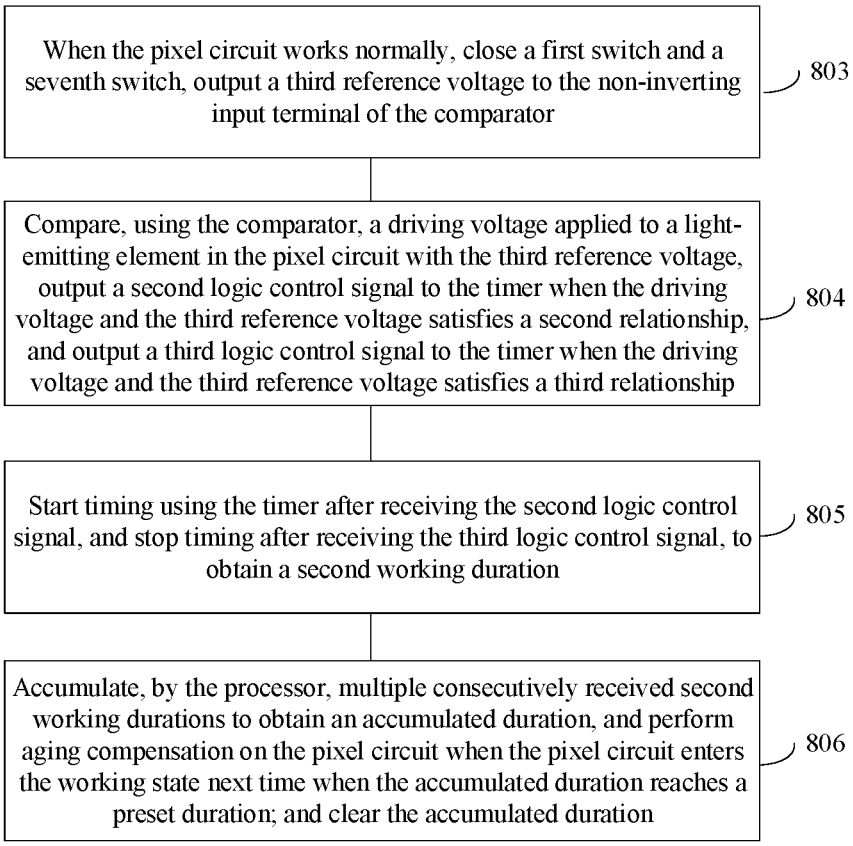
FIG. 11 shows a flowchart of other steps of a driving method of a pixel compensation circuit according to Embodiment 3 of the present disclosure.

In an embodiment, referring to FIG. 11, the method further includes:

in Step 804, in a case where the pixel circuit works normally, closing a first switch and a seventh switch, outputting a third reference voltage to the non-inverting input terminal of the comparator;

in Step 805, comparing, by the comparator, a driving voltage applied to a light-emitting element in the pixel circuit with the third reference voltage, outputting a second logic control signal to the timer when the driving voltage and the third reference voltage satisfies a second relationship, and outputting a third logic control signal to the timer when the driving voltage and the third reference voltage satisfies a third relationship;

in Step 806, starting timing by the timer after receiving the second logic control signal, and stopping timing after receiving the third logic control signal, to obtain a second working duration; and in Step 807, accumulating, by the processor, multiple consecutively received second working durations to obtain an accumulated duration, and performing aging compensation on the pixel circuit when the pixel circuit enters the working state next time in a case where the accumulated duration reaches a preset duration; and clearing the accumulation duration.

In the embodiment of the present application, the anode voltage of the OLED is detected to determine whether the OLED emits light in the embodiment, thereby triggering the light-emitting timing. In an example, the operational amplifier is opened by EN (EN is the abbreviation of "enable" in English to indicate enable, which means that each circuit or circuit can work), the first switch SW1 and the seventh switch SW7 are closed, the other switches are opened, and the positive terminal of the comparator is connected to the reference voltage Vref3 (which is slightly lower than the voltage required for OLED to emit light). Once the voltage of the node N5 is higher than Vref3, it is determined to enter the light-emitting state, and the timer starts timing until the anode voltage of the OLED is lower than Vref3, stop timing, to obtain the second working duration, which is then sent to the processor. The processor stores the plurality of previous second working durations, and accumulates the plurality of second working durations to obtain the accumulated duration. In a case where the accumulated duration reaches the preset duration, when the pixel circuit enters the working state next time, the aging compensation is performed on the pixel circuit; and the accumulated duration is cleared. Because the OLED aging is a relatively long process, generally, there is no need for real-time compensation. The compensation may be performed at each defined fixed time, for example, the compensation may be performed every 10 days. Also, when the accumulated duration reaches an integer multiple of 10 days, the aging compensation for the OLED is performed once at the next startup For the foregoing method embodiments, for the sake of simple description, they are all expressed as a series of action combinations, but those skilled in the art should know that the present disclosure is not limited by the described sequence of actions, because some steps, according to the present disclosure, can be performed in other order or simultaneously. Secondly, those skilled in the art should also know that the embodiments described in the specification are all preferred embodiments, and the involved actions and circuits are not necessarily required by the present disclosure.

The various embodiments in this specification are described in a progressive manner. Each embodiment focuses on the differences from other embodiments, and the same or similar parts between the various embodiments can be referred to each other.

Finally, it should be noted that in the disclosure, relational terms such as first and second are only used to distinguish an entity or operation from another entity or operation, and do not necessarily require or imply any such actual relationship or order between these entities or operations. Moreover, the terms "comprise", "include", or any other variants thereof are intended to cover non-exclusive inclusion, so that a process, method, product, or device that includes a series of elements includes not only these elements, but also the elements that are not explicitly listed, or also includes elements inherent to the process, method, product, or device. If there are no more restrictions, the elements defined by the expression "including a . . . " does not exclude the existence of other identical elements in the process, method, product, or device that includes the elements.

The pixel compensation circuit, the display device, and the driving method of the pixel compensation circuit provided by the present disclosure are described in detail above. Specific examples are used herein to illustrate the principles and implementations of the present disclosure. The description of the above embodiments is only used to help understand the methods and core concept of the present disclosure; at the same time, for those of ordinary skill in the art, according to the concept of the present disclosure, there may be changes in the specific implementation and the scope of application. In summary, the content of the specification should not be construed as a limitation of the present disclosure.

What is claimed is:

1. A pixel compensation circuit, comprising:

an integration circuit, a comparison circuit, a timing circuit, and a processor, wherein:

a terminal of the integration circuit is coupled to a pixel circuit, and another terminal of the integration circuit is coupled to a first node, and the integration circuit is configured to integrate a driving current of the pixel circuit to obtain an output voltage;

a terminal of the comparison circuit is connected to the first node, and another terminal of the comparison circuit is coupled to the timing circuit, and the comparison circuit is configured to receive the output voltage and compare the output voltage with a first reference voltage, and output a first logic control signal when the output voltage and the first reference voltage satisfy a first relationship;

the timing circuit is coupled to the processor and a start signal input terminal, and is configured to start timing when a start signal is received, and stop timing when the first logic control signal is received, thereby obtaining a first working duration; and the processor is configured to obtain the first working duration, obtain a target driving current of the pixel circuit corresponding to the first working duration according to a correspondence between working durations and pixel driving currents, and obtain a compensation parameter according to the target driving current, wherein:

the comparison circuit is further configured to compare a driving voltage applied to a light-emitting element in the pixel circuit with a third reference voltage, output a second logic control signal when a comparison result satisfies a second relationship, and output a third logic control signal when the comparison result satisfies a third relationship;

the timing circuit is further configured to start timing after receiving the second logic control signal, and stop timing after receiving the third logic control signal, thereby obtaining a second working duration; and the processor is further configured to perform aging compensation on the pixel circuit when an accumulated duration of a plurality of consecutive second working durations reaches a preset duration.

2. The pixel compensation circuit according to claim 1, wherein:

the integration circuit comprises an operational amplifier, a first capacitor, a first switch, a second switch, and a third switch;

an inverting input terminal of the operational amplifier is coupled to a second node, a non-inverting input terminal of the operational amplifier is coupled to a second reference voltage input terminal, and an output terminal of the operational amplifier is coupled to the first node through the third switch;

the second node is coupled to the pixel circuit through the first switch; and a first terminal of the first capacitor is coupled to the second node, and a second terminal of the first capacitor is coupled to the first node through the second switch.

3. The pixel compensation circuit according to claim 2, wherein:

the integration circuit further comprises a reference current source, a fourth switch and a fifth switch;

the reference current source is coupled to the second node through the fourth switch, and the second terminal of the first capacitor is grounded through the fifth switch; and the processor is coupled to the second node through a sixth switch and a seventh switch.

4. The pixel compensation circuit according to claim 1, wherein the comparison circuit comprises a comparator, an inverting input terminal of the comparator is coupled to the first node, a non-inverting input terminal of the comparator is coupled to a first reference voltage input terminal, and an output terminal of the comparator is coupled to the timing circuit.

5. The pixel compensation circuit according to claim 1, wherein the timing circuit comprises a timer, a first terminal of the timer is connected to the comparison circuit, a second terminal of the timer is coupled to the start signal input terminal, and a third terminal of the timer is coupled to the processor.

6. The pixel compensation circuit according to claim 1, wherein the first node and a second node are coupled through a seventh switch.

7. A driving method of a pixel compensation circuit applied to the pixel compensation circuit, comprising:

providing the pixel compensation circuit, the pixel compensation circuit comprising an integration circuit, a comparison circuit, a timing circuit, and a processor, wherein:

a terminal of the integration circuit is coupled to a pixel circuit, and another terminal of the integration circuit is coupled to a first node, and the integration circuit is configured to integrate a driving current of the pixel circuit to obtain an output voltage;

a terminal of the comparison circuit is connected to the first node, and another terminal of the comparison circuit is coupled to the timing circuit, and the comparison circuit is configured to receive the output voltage and compare the output voltage with a first reference voltage, and output a first logic control signal when the output voltage and the first reference voltage satisfy a first relationship;

the timing circuit is coupled to the processor and a start signal input terminal, and is configured to start timing when a start signal is received, and stop timing when the first logic control signal is received, thereby obtaining a first working duration; and the processor is configured to obtain the first working duration, obtain a target driving current of the pixel circuit corresponding to the first working duration according to a correspondence between working durations and pixel driving currents, and obtain a compensation parameter according to the target driving current, wherein:

the comparison circuit is further configured to compare a driving voltage applied to a light-emitting element in the pixel circuit with a third reference voltage, output a second logic control signal when a comparison result satisfies a second relationship, and output a third logic control signal when the comparison result satisfies a third relationship;

the timing circuit is further configured to start timing after receiving the second logic control signal, and stop timing after receiving the third logic control signal, thereby obtaining a second working duration; and the processor is further configured to perform aging compensation on the pixel circuit when an accumulated duration of a plurality of consecutive second working durations reaches a preset duration;

obtaining the driving current of the pixel circuit; and starting timing based on the start signal, integrating the driving current to obtain the output voltage, comparing the output voltage with the first reference voltage, and outputting the first logic control signal when the output voltage and the first reference voltage satisfy the first relationship;

stop timing when the first logic control signal is obtained, thereby obtaining the first working duration; and obtaining the target driving current of the pixel circuit corresponding to the first working duration according to the correspondence between working durations and pixel driving currents, and obtaining the compensation parameter according to the target driving current.

8. The driving method according to claim 7, wherein:

the integration circuit comprises an operational amplifier, a first capacitor, a first switch, a second switch, and a third switch;

an inverting input terminal of the operational amplifier is coupled to a second node, a non-inverting input terminal of the operational amplifier is coupled to a second reference voltage input terminal, and an output terminal of the operational amplifier is coupled to the first node through the third switch;

the second node is coupled to the pixel circuit through the first switch;

a first terminal of the first capacitor is coupled to the second node, and a second terminal of the first capacitor is coupled to the first node through the second switch;

the comparison circuit comprises a comparator, an inverting input terminal of the comparator is coupled to the first node, a non-inverting input terminal of the comparator is coupled to a first reference voltage input terminal, and an output terminal of the comparator is coupled to the timing circuit;

the timing circuit comprises a timer, a first terminal of the timer is connected to the comparison circuit, a second terminal of the timer is coupled to the start signal input terminal, and a third terminal of the timer is coupled to the processor; and the driving method further comprises closing the first switch, the second switch, and the third switch, inputting the start signal to the timer, inputting the second reference voltage to the non-inverting input terminal of the operational amplifier, and inputting the first reference voltage to the non-inverting input terminal of the comparator.

9. The driving method according to claim 8, wherein:

the integration circuit further comprises a reference current source, a fourth switch and a fifth switch;

the reference current source is coupled to the second node through the fourth switch, and the second terminal of the first capacitor is grounded through the fifth switch;

the processor is coupled to the second node through a sixth switch and a seventh switch, before the obtaining the driving current of the pixel circuit, the driving method further comprises:

closing the fourth switch, the fifth switch, the sixth switch, and the seventh switch;

outputting a constant current, using the reference current source, to charge the first capacitor; and obtaining, by the processor, a voltage of the second node, calculating, by the processor, a parameter of the first capacitor according to the voltage of the second node, and calculating an error parameter of the first capacitor according to the parameter of the first capacitor and a standard capacitor parameter, the error parameter being used for adjusting the compensation parameter.

10. The driving method according to claim 9, further comprising:

closing the first switch and the seventh switch, and outputting the third reference voltage to the non-inverting input terminal of the comparator;

comparing, using the comparator, the driving voltage with the third reference voltage, outputting the second logic control signal to the timer when the driving voltage and the third reference voltage satisfies the second relationship, and outputting the third logic control signal to the timer when the driving voltage and the third reference voltage satisfies the third relationship;

starting timing using the timer after receiving the second logic control signal, and stopping timing after receiving the third logic control signal to obtain the second working duration; and accumulating, by the processor, multiple consecutively received second working durations to obtain the accumulated duration, and performing the aging compensation on the pixel circuit when the accumulated duration reaches the preset duration.

11. A display device, comprising:

a pixel compensation circuit, the pixel compensation circuit comprising an integration circuit, a comparison circuit, a timing circuit, and a processor, wherein:

a terminal of the integration circuit is coupled to a pixel circuit, and another terminal of the integration circuit is coupled to a first node, and the integration circuit is configured to integrate a driving current of the pixel circuit to obtain an output voltage;

a terminal of the comparison circuit is connected to the first node, and another terminal of the comparison circuit is coupled to the timing circuit, and the comparison circuit is configured to receive the output voltage and compare the output voltage with a first reference voltage, and output a first logic control signal when the output voltage and the first reference voltage satisfy a first relationship;

the timing circuit is coupled to the processor and a start signal input terminal, and is configured to start timing when a start signal is received, and stop timing when the first logic control signal is received, thereby obtaining a first working duration; and the processor is configured to obtain the first working duration, obtain a target driving current of the pixel circuit corresponding to the first working duration according to a correspondence between working durations and pixel driving currents, and obtain a compensation parameter according to the target driving current, wherein:

the comparison circuit is further configured to compare a driving voltage applied to a light-emitting element in the pixel circuit with a third reference voltage, output a second logic control signal when a comparison result satisfies a second relationship, and output a third logic control signal when the comparison result satisfies a third relationship;

the timing circuit is further configured to start timing after receiving the second logic control signal, and stop timing after receiving the third logic control signal, thereby obtaining a second working duration; and the processor is further configured to perform aging compensation on the pixel circuit when an accumulated duration of a plurality of consecutive second working durations reaches a preset duration.

12. The display device according to claim 11, wherein:

the integration circuit comprises an operational amplifier, a first capacitor, a first switch, a second switch, and a third switch;

an inverting input terminal of the operational amplifier is coupled to a second node, a non-inverting input terminal of the operational amplifier is coupled to a second reference voltage input terminal, and an output terminal of the operational amplifier is coupled to the first node through the third switch;

the second node is coupled to the pixel circuit through the first switch; and a first terminal of the first capacitor is coupled to the second node, and a second terminal of the first capacitor is coupled to the first node through the second switch.

13. The display device according to claim 12, wherein:

the integration circuit further comprises a reference current source, a fourth switch and a fifth switch;

the reference current source is coupled to the second node through the fourth switch, and the second terminal of the first capacitor is grounded through the fifth switch; and the processor is coupled to the second node through a sixth switch and a seventh switch.

14. The display device according to claim 11, wherein the comparison circuit comprises a comparator, an inverting input terminal of the comparator is coupled to the first node, a non-inverting input terminal of the comparator is coupled to a first reference voltage input terminal, and an output terminal of the comparator is coupled to the timing circuit.

15. The display device according to claim 11, wherein the timing circuit comprises a timer, a first terminal of the timer is connected to the comparison circuit, a second terminal of the timer is coupled to the start signal input terminal, and a third terminal of the timer is coupled to the processor.

16. The display device according to claim 11, wherein the first node and a second node are coupled through a seventh switch.

* * * * *